US005225742A

United States Patent [19]

Beasley

[11] Patent Number: 5,225,742

[45] Date of Patent: Jul. 6, 1993

[54] SOLID STATE BALLAST FOR HIGH INTENSITY DISCHARGE LAMPS

[75] Inventor: Denny D. Beasley, Fairfield, Ohio

[73] Assignee: Delta Coventry Corporation, Dayton, Ohio

[21] Appl. No.: 805,597

[22] Filed: Dec. 11, 1991

[51] Int. Cl.[5] ..... H05B 41/36

[52] U.S. Cl. ..... 315/307; 315/224; 315/DIG. 7

[58] Field of Search ..... 315/307, 308, 291, 293, 315/194, 360, 171, 173, 176, 224, 311, DIG. 5, DIG. 7

[56] References Cited

U.S. PATENT DOCUMENTS

| | | | |
|---|---|---|---|
| 32,953 | 6/1989 | Nilssen | 315/224 |
| 4,029,993 | 6/1977 | Alley et al. | 315/219 |
| 4,057,750 | 11/1977 | Elms et al. | 315/86 |
| 4,063,108 | 12/1977 | Klett et al. | 307/64 |
| 4,233,558 | 11/1980 | Gaertner | 315/DIG. 7 |
| 4,277,728 | 7/1981 | Stevens | 315/307 |
| 4,370,600 | 1/1983 | Zansky | 315/244 |
| 4,422,016 | 12/1983 | Kurple | 315/308 |
| 4,437,043 | 3/1984 | Pitel | 315/308 |
| 4,567,404 | 1/1986 | Flugan | 315/205 |
| 4,580,080 | 4/1986 | Smith | 315/199 |
| 4,641,061 | 2/1987 | Munson | 315/210 |
| 4,642,525 | 2/1987 | Widmayer | 315/224 |
| 4,751,398 | 6/1988 | Ertz | 307/66 |
| 4,904,907 | 2/1990 | Allison | 315/DIG. 7 |
| 5,004,947 | 4/1991 | Nilssen | 315/224 |
| 5,004,953 | 4/1991 | McDonald | 315/86 |
| 5,710,177 | 1/1973 | Ward | 315/224 |

*Primary Examiner*—Eugene R. LaRoche
*Assistant Examiner*—A. Zarabian
*Attorney, Agent, or Firm*—Killworth, Gottman, Hagan & Schaeff

[57] ABSTRACT

A solid state ballast includes a pulse width modulation (PWM) circuit to maintain substantially constant power to a discharge lamp over its lifetime. The PWM circuit is powered from a high voltage (HV) DC source and is referenced to the source voltage level. Lamp power is maintained substantially constant provided the HVDC source maintains at least a normal lamp operating voltage level and is operated at a reducing power levels as the HVDC source voltage drops below the normal lamp operating level. Lamp operating power can also be controlled by selecting the PWM reference voltage level. For initial power-up, a bootstrap power supply is provided to power solid state circuitry of the ballast from the HVDC source. The bootstrap power supply is shut-down by operation of a primary low voltage power supply or if operated for more than a few seconds. A lamp is driven through a capacitor which is charged to a high voltage for lamp ignition. A relay selectively shorts the capacitor for a high power connection to the lamp. A timer circuit cycles the relay approximately every two seconds and is disabled upon lamp ignition for high power lamp operation.

21 Claims, 1 Drawing Sheet

SOLID STATE BALLAST FOR HIGH INTENSITY DISCHARGE LAMPS

BACKGROUND OF THE INVENTION

The present invention relates generally to the operation of high intensity discharge lamps and, more particularly, to a solid state ballast for operation of such lamps.

High intensity discharge (HID) lamps such as mercury, metal halide and high pressure sodium lamps are popular sources of light because of their high efficiency in converting electrical energy into light. Unfortunately, discharge lamps typically are operated through ballast circuits which are very inefficient. A ballast circuit is connected between a power source and a lamp to provide a high initial voltage to start the lamp and then to limit current through the lamp to safe levels during continued operation.

The most common conventional ballast circuit includes a transformer having a variably coupled secondary winding such that the magnetic coupling of the secondary winding is not constant. Thus, the voltage on the secondary winding can vary according to the load which it is driving. Effectively, the voltage varies to maintain a substantially constant current through the secondary circuit. Such operation is very favorable for the control of discharge lamps because the constant current maintains stable power delivery to the lamps and prevents the natural tendency of the lamps to "runaway" upon ignition when the impedance goes to virtually zero. The lamp will eventually equilibrate based on the coupling strength that was built into the transformer.

Such conventional ballasts are represented as operating lamps at constant wattage or power based on the constant current and the ideal that the voltage across a lamp also remains constant. However, lamp voltage increases at a rate of about one volt per thousand hours of operating time such that lamp power consumption creeps upward with the age of the lamp. Power consumption can increase 20% over the life of a lamp.

Another problem with such conventional ballasts is the wide variations in power level at which a lamp equilibrates. The variations in equilibration power is due to the inability to precisely set the magnetic path strengths within the ballast transformer and can result in operating power level errors of up to 25% of nominal. Once a transformer has been made, it is not possible to change the power output level of a lamp operated by a ballast including the transformer, i.e. a lamp is either on and operated at the transformer defined power level or the lamp is off. This lack of control effectively eliminates lighting as a variable in energy management strategies.

Still another problem with such conventional ballasts is noise generated by lamp operation. Since the core of a transformer of a conventional ballast is constructed of steel laminations, as the transformer ages the laminations loosen and can produce high noise levels. Noise generation is compounded by the nature of HID lamps which draw current in pulses centered around the center 30% of a driving sine wave power signal. The current pulsing causes rapid flux changes in the core and aggravates vibration of any loose laminations to produce load buzzing not ordinarily associated with transformer operation. Such transformers also tend to be large, bulky and heavy even for low lamp power levels.

While a variety of less conventional ballast circuit configurations have been employed in the prior art including electronic circuitry, controlled core saturations and others, none have been totally acceptable for overcoming the problems encountered in conventional transformer ballast circuits.

Accordingly, there is a need for an improved ballast circuit having higher efficiency, substantially constant or controllable lamp power over the life of a lamp, smaller size with reduced weight and low noise operation.

SUMMARY OF THE INVENTION

This need is met by the invention of the present application wherein power provided to a discharge lamp is controlled via a pulse width modulation circuit to maintain substantially constant power to the lamp during the entire life of the lamp. The pulse width modulation circuit is powered from a high voltage direct current (DC) voltage source and the pulse width modulation circuit is referenced to the voltage level of the high voltage DC source. The power to a controlled lamp is maintained substantially constant provided the high voltage DC source maintains a voltage level at or above a given voltage level which defines normal operation for the lamp. In addition, a controlled lamp will continue to operate without being extinguished as the voltage level of the high voltage DC source drops, within reasonable limits. Reduced levels of operation are automatically selected due to referencing the pulse width modulation circuit to the voltage level of the high voltage DC source.

An additional advantage of this characteristic of the present invention is that the operating power level of a lamp can be controlled by selecting the reference level provided to the pulse width modulation circuit. Thus, the power level can be manually selected, for example for power control purposes, or the power level is automatically reduced if the voltage level of the high voltage DC source falls below a given voltage level due to problems within the power source used to drive the lamp or otherwise.

The ballast circuit of the present invention includes solid state circuitry which must be powered by DC power at relatively low voltage levels compared to the voltage level of the high voltage DC source. To eliminate the need for a low voltage power supply which is driven directly from an input power supply for example an alternating current (AC) power line, a primary power supply is operated directly from the circuitry used to power a lamp. To overcome the problem of initial power-up of the solid state circuitry when the lamp is first turned-on, a bootstrap power supply is provided. The bootstrap power supply converts power from the high voltage DC source to a low voltage level suitable for driving the solid state circuitry. The bootstrap power supply need only operate long enough to permit the primary low voltage power supply to become operable and accordingly, the bootstrap power supply is automatically shut-down by operation of the primary low voltage power supply.

For cost and size reduction reasons, the bootstrap power supply is designed only for operation during the limited time periods required such that it could become damaged for more extended operation. To prevent such damage, protection means is built into the bootstrap power supply. The protection means takes the form of a thermistor and associated resistor which cooperate to rapidly reduce the power through the bootstrap power supply for extended operating periods. Operation of the protection means is by means of thermistor heating by the resistor such that the resistance of the thermistor increases to a current limiting resistance level to protect the bootstrap power supply and prevent damage which could otherwise result due to an extended operating time period.

The ballast circuit also provides a direct connection of a lamp driver circuit to the lamp upon successful ignition of the lamp. The lamp driver circuit is normally connected to the lamp through a capacitor which is of sufficient size and power rating to permit the lamp to operate after ignition, however at a relatively low power level. A lamp igniter circuit provides a high voltage DC voltage across the capacitor for igniting the lamp and a relay is provided for selectively shorting out the capacitor to provide a direct, high power connection of the lamp driver circuit to the lamp. To ensure proper ignition of a lamp, a timer circuit is provided to open and close the relay on an approximately two second on/off cycle time. The current through the lamp driver circuit is monitored and the timer circuit is disabled once the lamp is ignited such that the capacitor is shorted out to permit normal high power operation of the lamp.

In accordance with one aspect of the present invention, a ballast circuit for operating a discharge lamp comprises a source of high voltage direct current power. Low voltage direct current power supply means is provided for converting the high voltage direct current power to low voltage direct current power for operation of the ballast circuit. Lamp starter means is connected to the discharge lamp for initiating operation of the lamp. Lamp driver means provides for operating the discharge lamp through capacitor means which connect the lamp driver means to the discharge lamp. Pulse width modulation means generate control pulses for the lamp driver means in response to current flow in the lamp driver means. Switch means selectively short out the capacitor means, and timer means for control the switch means in response to current flow in the lamp driver means.

The ballast circuit preferably further comprises timer control means for enabling the timer means prior to operation of the discharge lamp. The timer means cyclically operates the switch means while enabled by the timer control means such that the switch means shorts out the capacitor means on a cycle of approximately two seconds shorted and two seconds not shorted. The timer control means may comprise a comparator circuit which compares a control signal of the pulse width modulation means to a defined reference level signal Thus, the time control can determine whether the lamp has ignited and, if so, maintain the short across the capacitor means.

While a variety of power sources are possible, a convenient embodiment is to have the source of high voltage direct current power comprise high voltage direct current power supply means for receiving alternating current power and converting it to high voltage direct current power. For cost and size considerations, the low voltage direct current power supply means preferably comprises primary supply means coupled to the driver means for generating low voltage direct current power for steady state operation of the ballast circuit, and bootstrap power supply means coupled between the source of high voltage direct current power and the primary power supply means for supplying low voltage direct current power for initial operation of the ballast circuit.

Since the bootstrap power supply circuit will standardly operate for only a very brief period of time, however at high current levels exceeding long term capabilities of the supply, the bootstrap power supply means includes current limiter means for limiting current flow therethrough for extended operating times. The current limiter means may comprise a series connected resistor and thermistor. To the same end, the bootstrap power supply means also includes shut-off means for turning off the bootstrap power supply means upon proper operation of the primary power supply means. The bootstrap power supply means may comprise dc-to-dc converter means for converting high voltage direct current power to low voltage direct current power with the shut-off means being connected to the primary power supply means for disabling the dc-to-dc converter means upon generation of low voltage power by the primary power supply means. The shut-off means may comprise an optical isolator.

To prevent excessive current from being supplied to the lamp driver means, the pulse width modulation means preferably comprises current limiter means for terminating control pulses passed to the lamp driver means in response to current flow in the lamp driver means exceeding a defined limit. For versatility, selector means is operable for selecting the defined limit for current flow in the lamp driver means.

Preferably, the pulse width modulation means is further responsive to the source of high voltage direct current power and further comprises integrator means for integrating signals representative of current flow in the lamp driver means to generate an integrated drive current signal. The integrated drive current signal is compared to a defined portion of a voltage level of the source of high voltage direct current power by comparator means which generates a control signal to define widths of the control pulses passed to the lamp driver means.

In the preferred embodiment of the present invention, the defined portion of the voltage level of the high voltage direct current power is selected by voltage divider means connected to the source of high voltage direct current power. Voltage regulator means is connected across the voltage divider means for presetting a fixed voltage across the voltage divider means provided the voltage level of the high voltage direct current source is at or above a given voltage level. In this way the fixed voltage is maintained regardless of variations of the high voltage direct current source at or above the given voltage level but drops in proportion to the voltage level of the high voltage direct current source if the voltage level thereof falls below the given voltage level to reduce the current provided to the lamp while preventing the lamp from being extinguished.

Preferably, the voltage regulator means comprises a zener diode. Applicant of the present application has determined that it is advantageous to operate the pulse width modulation at a frequency which is a multiple of approximately 7.3 kilohertz. Preferably, the pulse width modulation means is operated at a frequency of approximately 29.2 kilohertz.

It is an object of the present invention to provide an improved ballast circuit for operating discharge lamps and particularly high intensity discharge lamps; to provide an improved ballast circuit for operating discharge lamps and particularly high intensity discharge lamps wherein a pulse width modulation circuit is controlled in response to a voltage level of a high voltage DC source and current flow in a lamp driver circuit; to provide an improved ballast circuit for operating discharge lamps and particularly high intensity discharge lamps wherein cost and size are reduced by alternate connection of a lamp driver circuit to a lamp via a low power conducting capacitor which is periodically shorted out until the lamp is ignited and continually shorted out thereafter; and, to provide an improved ballast circuit for operating discharge lamps and particularly high intensity discharge lamps wherein cost and size are reduced by alternate connection of a lamp driver circuit to a lamp via a low power conducting capacitor which is periodically shorted out until the lamp is ignited and continually shorted out thereafter with power-up of solid state circuitry of the ballast circuit being performed by a bootstrap power supply which is disabled or disconnected upon lamp ignition.

Other objects and advantages of the invention will be apparent from the following description, the accompanying drawing and the appended claims.

DETAILED DESCRIPTION OF THE INVENTION

Figure 1:
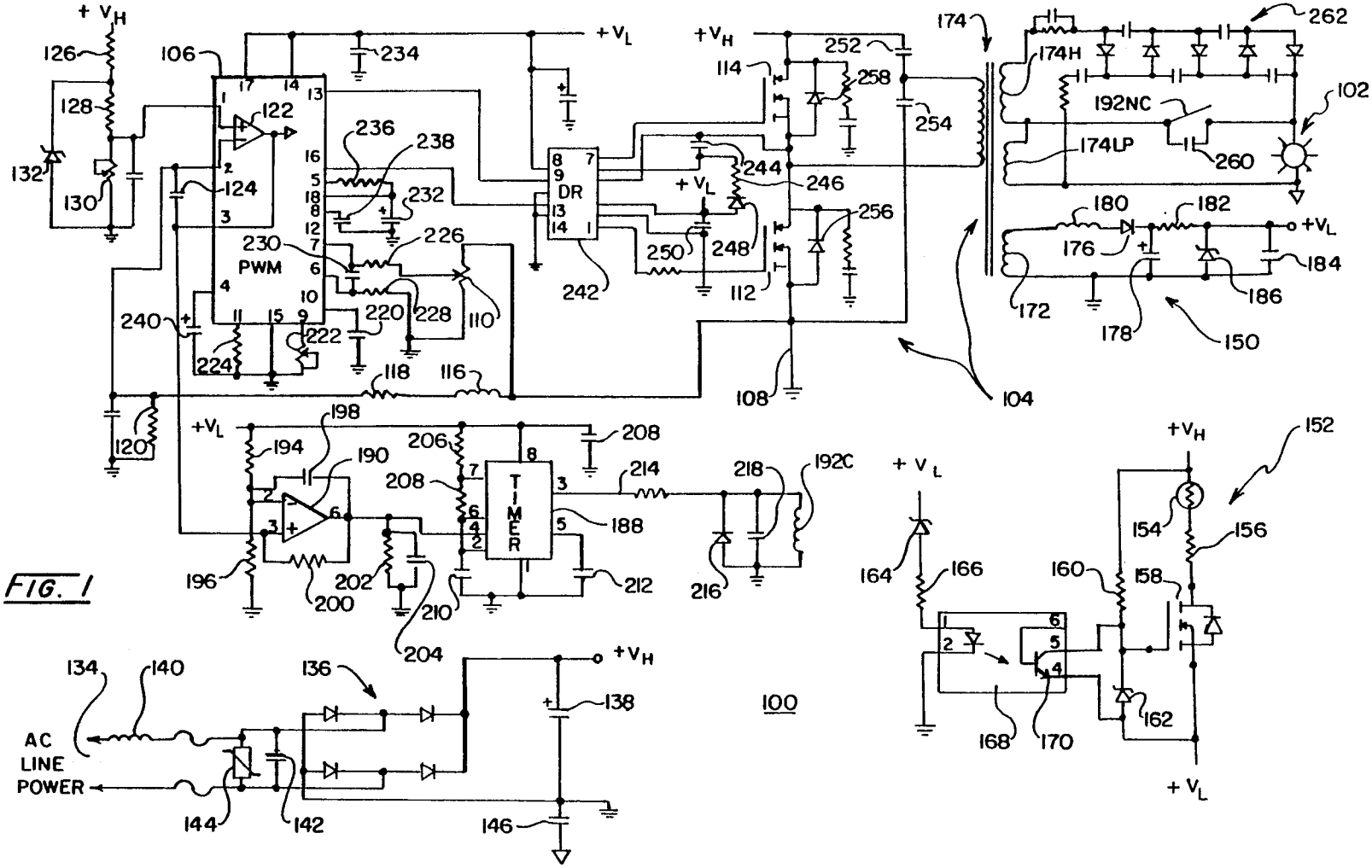
FIG. 1 is an electrical schematic diagram of a solid state ballast circuit in accordance with the present invention.

A solid state ballast circuit 100 in accordance with the present invention for operating discharge lamps and particularly high intensity discharge lamps such as mercury, metal halide and high pressure sodium lamps exemplified by a lamp 102 will now be described with reference to FIG. 1 which is an electrical schematic diagram of an illustrative embodiment of the invention. In view of discharge lamp operating characteristics at the moment of lamp ignition, i.e., lamp impedance makes a transition from a virtual open circuit to a virtual short circuit, a two step lamp control approach is taken to achieve successful and survivable lamp ignition and warm-up.

The first step is to limit current to the lamp 102 to prevent its low impedance of first ignition from "overcurrenting" lamp driver means 104 but at the same time provide a peak current level which is many times the nominal drive current level to expedite lamp equilibration. The second step is performed as the peak current through the lamp driver means 104 rapidly falls upon lamp ignition.

In the operating mode characteristic of the second step or average current mode, pulses representative of current passing through the lamp driver means are averaged and the resulting averaged level is compared to a preset reference level to generate an error signal voltage. The error signal voltage is then used to adjust the width of pulses provided by a pulse width modulation (PWM) circuit 106 such that the current passing through the lamp driver means 104 is made to correspond the averaged level to the preset reference level.

In the illustrated embodiment, the pulse width modulation (PWM) circuit 106 comprises an SG3526 commercially available from the Motorola Corporation. Current in the lamp driver means 104 is sensed by monitoring the voltage across a current sensing resistor 108. The maximum current level for the lamp driver means 104 is set by a potentiometer 110 which is connected to a current limit input on the PWM circuit 106. The maximum current level is set to highest value which can be tolerated by the lamp driver means 104 and more particularly by the insulated gate bipolar transistors (IGBT's) 112, 114 to provide rapid warm up of the lamp 102. The IGBT's are preferred because they will withstand the harsh conditions during lamp start-up.

For the average current mode of operation, current sample pulses from the sensing resistor 108 are passed through an inductor 116 to remove unwanted noise and applied to resistors 118, 120. The resistors 118, 120 determine the gain of an operational amplifier 122, which is internal to the PWM circuit 106 and set up as an integrating/error amplifier for the ballast circuit of the present application. A capacitor 124 connected to the PWM circuit 106 integrates the current sample pulses into a direct current (DC) voltage level for comparison to the preset reference level to generate the error signal voltage. The preset reference level is generated by resistors 126, 128 and a potentiometer 130 which operates in coordination with voltage regulator means, comprising a zener diode 132 in the illustrated embodiment, connected across voltage divider means comprising the resistor 128 and the potentiometer 130. The combination of the zener diode 132 with the voltage divider means provides automatic control for operation of the lamp 102 at reduced power levels in the event of reduced input power as will be described hereinafter.

The operating frequency of the PWM circuit and hence the ballast circuit 100 of the present application is very important to the proper operation of the ballast circuit 100. Applicant of the present application has been determined that specific frequencies ensure stable operation of the ballast circuit 100 and the lamp 102. In the preferred embodiment of the ballast circuit, operation is at approximately 29.2 kilohertz (Khz) and more particularly at a frequency of 29.2 Khz $\pm 2.5\%$. At this frequency all lamp sizes and arc lengths are stable. It appears from empirical testing that other stable frequencies occur at multiples of 7.3 Khz starting at 7.3 Khz.

With the foregoing as introductory overview, various aspects and operations of the solid state ballast circuit 100 will now be described in more detail. While a variety of power sources including single phase alternating current (AC) supplies, multiple phase AC supplies and direct current (DC) supplies can be used to operate the ballast circuit 100, the illustrated embodiment is connected to a source of single phase AC power 134 which is converted to provide a source of high voltage DC power $V_H$, for example +175 volts.

The AC power is connected to a full wave diode bridge circuit 136 which rectifies the AC power with the resulting DC power being filter and stored on a capacitor 138. To avoid line pulsing and the resulting bad power factor typical of most devices that use direct line rectification components, the AC power is connected to the bridge circuit 136 through an inductor 140 and a capacitor 142 which form a nonlinear waveshaping circuit. The inductor 140 also prevents noise generated within the ballast circuit 100 from escaping to the AC power line and "softens" the line side impedance of the ballast circuit 100 so that a varistor 144 can suppress the noise to acceptable levels. A capacitor 146 bypasses the rectifier ground to line ground.

While the ballast circuit 100 operates from the high voltage $V_H$ on the capacitor 138, the solid state circuitry of the ballast circuit requires a substantially lower voltage $V_L$, for example +15 volts, for operation. Primary power supply means 150 is provided to generate $V_L$ once the ballast circuit 100 is fully operating as will be described. However, when the lamp 102 is to be lighted and the ballast circuit 102 is first connected to the AC power 134, low voltage power $V_L$ must be provided for initial operation of the solid state circuitry. This initial low voltage power is provided by a bootstrap power supply 152 which connects the high voltage $V_H$ to the primary power supply means 150 through a thermistor 154, a resistor 156 and an IGBT supply transistor 158 in the illustrated embodiment. As will be apparent to those skilled in the art, the transistor 158 could comprise any one of a variety of available high input impedance switching devices.

The resistor 156 is sized to sustain operation of the bootstrap power supply 152 and hence the ballast circuit 100 for only a few seconds to allow the primary power supply means 150 to stabilize. The transistor 158 serves as a switch to connect the resistor 156 to the $V_L$ of the primary power supply means 150 during start-up of the primary power supply means 150 and disconnect it if start-up is not successful. In case primary power supply 150 is unsuccessful, the thermistor 154 is closely associated with the resistor 156 which heats the thermistor 154 to thereby increase its resistance to a level which limits power dissipation in the resistor 156 to safe levels. The transistor 158 is switched on through a resistor 160 which charges the gate capacitance to a voltage level established by a zener diode 162. After the primary power supply 150 is operating and generates an output voltage level sufficient to pass current through a zener diode 164, current flows through a resistor 166 to activate an optoisolator 168 which in turn saturates a transistor 170 within the optoisolator 168 to short out the gate of the transistor 158 and thereby terminate operation of the bootstrap power supply 152.

The low voltage power $V_L$ is generated by an auxiliary winding 172 of a lamp transformer 174 of the lamp driver means 104. A diode 176 half wave rectifies the winding voltage which is then filtered by a capacitor 178. An inductor 180 limits the rate of rise of current in the diode 176. A resistor 182 passes the rectified power to a capacitor 184 whose voltage level is regulated by a zener diode 186.

An integrated circuit taking the form of an MC1555 timing circuit commercially available from the Motorola Corporation in the illustrated embodiment, defines timer means 188 which is in turn controlled by timer control means 190 taking the form of an operational amplifier in the illustrated embodiment. The timer means 188 defines an ignition cycle control and timing circuit for a relay 192 having a control coil 192C and a normally closed contact 192NC.

When the ballast circuit 100 is initially powered-up, the lamp 102 is a virtual open circuit, i.e., there is no lamp load, and the voltage on the inverting or—input of the operational amplifier 122 is below the preset reference level defined at the junction between the potentiometer 130 and the resistor 128. Under these conditions, the error signal from the operational amplifier 122 controls the PWM circuit 106 to provide maximum pulse width signals to the lamp driver means 104 until the lamp 102 is ignited and presents a lamp load to the ballast circuit 100.

Upon ignition of the lamp 102, the pulse width signals are initially limited by the setting of the potentiometer 110 which limits the current to a safe level as the lamp 102 warms up and develops an impedance which is greater than its nearly zero starting impedance. As the current drops below the maximum level defined by the setting of the potentiometer 110, control of the PWM circuit 106 changes to the average or integrated current mode of operation provided by the operation amplifier 122 and associated circuitry.

The output signal from the operational amplifier 122 is applied to the + input of the operational amplifier 190 which compares this signal to a voltage level established by resistors 194, 196 on its − input. A capacitor 198 limits the response rate of the operational amplifier 190 so that the timer means 188 is not affected by system noise. A resistor 200 adds a small level of hysteresis to the comparator action of the operational amplifier 190. A resistor 202 loads the output of the operational amplifier 190 and reduces its output saturation voltage. A capacitor 204 substantially eliminates any possibility of a false triggering of the timer means 188.

When the control voltage on the + input of the operational amplifier 190 is higher than the voltage level established by the resistors 194, 196 on the −input of the operational amplifier 122, its output signal is also high. The output voltage from the operational amplifier 190 is applied to a control input of the timer means 188, which control input, when high, enables the timer means 188 to cycle at about a 2 second on and 2 second off rate. Resistors 206, 208 and a capacitor 210 determine the cycle rate. A capacitor 212 prevents noise from affecting the control voltage input of the timer means 188. The output signal of the timer means 188 drives the relay coil 192C through a resistor 214. A diode 216 and a Capacitor 218 dissipate and limit noise generated by stored energy in the relay coil 192C.

The PWM circuit 106 performs pulse width control for drive signals provided to the lamp driver means 104. The frequency of operation of the PWM 106 is determined by a capacitor 220 and the resistance of a potentiometer 222. The amount of dead time between alternate drive pulses is determined by a resistor 224. Steady state control on the lamp is controlled by the operational amplifier 122 as described. The preset reference level set by the resistors 126, 128 and the potentiometer 130 sets the operating power level for the lamp 102.

The zener diode 132 clamps the voltage at the junction of the resistors 126, 128 to a fixed voltage level provided the voltage level of the high voltage direct current power $V_H$ is at or above a given voltage level which is sufficient to make the zener diode 132 conduct. The voltage divider is supplied from the high voltage power source $V_H$ such that as its voltage level drops due to low line voltage or otherwise to a point below the given voltage level, the reference voltage generated by the voltage divider means also begins to drop thereby reducing the lamp power and lowering the equilibrated lamp voltage. This automatic adjustment arrangement enables the lamp 102 to remain ignited during large variations/drops of line voltages without extinguishing. Thus, the operating power level of the lamp 102 can be selected by control of the potentiometer 130. Once selected, the power level can still be controlled automatically by means of the reduction in control voltage at the potentiometer 130 if the high voltage source $V_H$ falls to a voltage level at which the zener diode 132 no longer conducts.

Resistors 226, 228 with capacitor 230 filter the sampled current pulses to remove unwanted transients that could cause a false current trip. Capacitors 232, 234 bypass an internal reference source and low voltage supply $V_L$, respectively. A resistor 236 maintains a reset input of the PWM circuit 106 high to enable normal operation. A capacitor 238 bypasses a shutdown input of the PWM circuit 106 such that it is not affected by ambient noise. A capacitor 240 controls the ramp on rate of the pulse output from the start-up condition. Operation of the PWM circuit 106 as described results in drive signals for a driver circuit 242 such as an IR 2110 integrated driver circuit which is commercially available from the International Resistor Corporation.

The illustrated driver circuit 242 provides level shifting in one drive such that only one drive needs to be referred to ground potential. The floating drive is attached to the transistor 114. Energy to operate the floating drive is stored on a capacitor 244 and is conducted through a resistor 246 and a diode 248. When the transistor 112 pulls its drain to ground potential, its source is nearly at ground level. Because the diode 248 is tied to $V_L$ and the source of the transistor 114 is near ground level, the capacitor 244 will charge to $V_L$ minus any voltage drops across the diode 248 and the transistor 114. The resistor 246 limits the rate of current rise to acceptable levels. The transfer of current pulses into the gates of the transistors 112, 114 require good bypassing at the drive circuit 242 which is accomplished by capacitors 244, 250.

The illustrated lamp driver means 104 would be classified as a half bridge configuration. The transistors 112, 114 are the active power switches and capacitors 252, 254 provide the passive coupling to complete the drive configuration. Diodes 256, 258 provide for the inductive return of energy stored in the inductances of the lamp transformer 174. The operation of the lamp driver means 104 is as follows:

1) The transistor 112 receives drive voltage and saturates.

2) Current flows through the capacitor 252, the primary winding of the lamp transformer 174 and then the drain of the transistor 112.

3) Drive terminates in the transistor 112.

4) Current flow transfers to the diode 258 as the transistor 112 turns off, and begins to decay.

5) A variable length of dead time will occur depending on the pulse width. The minimum time is that set by the resistor 224. The minimum dead time allows each of the transistors 112, 114 to fully turn off before the next one turns on.

6) Transistor 114 now receives drive voltage and saturates.

7) Current flows through the capacitor 254, reverses in the primary winding of the lamp transformer 174, then the drain of the transistor 114.

8) Drives terminates in the transistor 114.

9) Current flow transfers into the diode 256 as the transistor 114 turns off, and begins to decay.

10) After the dead time, the transistor 112 begins the cycle once again.

The lamp transformer 174 consists of a single primary winding and three secondary windings; however, in some lamp ignition topologies the high voltage winding 174H is not needed. The bottom winding or auxiliary winding 172 in the reference schematic forms part of the primary power supply for the low voltage internal source $V_L$. The second winding 174LP is for the lamp power and is coupled to the lamp 102 through a high voltage capacitor 260 to create an inelastic voltage drive. The high voltage winding 174H generates a high voltage pulse for the high voltage multiplier circuit 262.

While operation of the illustrated embodiment of a solid state ballast circuit in accordance with the present invention should be apparent for the foregoing detailed description, a brief description summarizing that operation will now be made. When the lamp 102 is to lighted, AC power 134 is connected to the input of the ballast circuit 100. The AC power 134 is rectified resulting in generation of a high voltage DC power source $V_H$ which appears across the capacitor 138. The high voltage power $V_H$ is connected throughout the ballast circuit 100 as shown in the drawing figure. To provide initial power to solid state circuitry within the ballast circuit 100, the bootstrap power supply 152 is activated and provides low voltage internal $V_L$.

Normally, the primary power supply means 150 will be activated to provide the low voltage internal $V_L$ which will disable the bootstrap power supply 152. If the bootstrap power supply 152 is required to operate for any period of time over a few seconds, it will shut itself down by means of the thermistor 154 and resistor 156 as described. Assuming proper operation of the primary power supply means 150, the ballast circuit 100 will continue to operate with the lamp driver means 104 be operated by the PWM circuit 106. The relay 192 is operated to open its normally closed contact 192NC such that the high voltage multiplier 262 generates high voltage across the capacitor 260 connected to the lamp 102 and the second secondary winding 174LP of the lamp transformer 174.

The lamp 102 should now ignite within the first 2 second time period provided for ignition by the timer means 188. After ignition of the lamp 102, power from the second secondary winding 174LP of the lamp transformer 174 is coupled to the lamp 102 through the high voltage capacitor 260 to sustain the lamp in an ignited state until the capacitor 260 can be bypassed by the relay 192 for normal operation of the lamp 102.

If the lamp 102 ignites as it normally will, the PWM circuit 106 is initially limited to the maximum current level set by the potentiometer 110 and, when the current reduces below this level the PWM circuit 106 shifts over to the average current mode. At this time, the timer means 188 is disabled by the operational amplifier 190 and, upon time-out, the relay 192 closes its normally closed contact 192NC to short out the capacitor 260 and enable normal high power operation of the lamp 102 without the limitation of the capacitor 260.

Lamp power can be manually selected by adjustment of the potentiometer 130 and, in the event the voltage level of the high voltage DC power source $V_H$ falls below a given voltage level set by the zener diode 132, lamp power is automatically reduced in correspondence with the voltage level of the high voltage DC power source $V_H$.

If the lamp 102 does not ignite upon initial operation of the ballast circuit 100, the timer means 188 will short out and reconnect the capacitor 260 to the lamp on an approximately 2 second cycle until the lamp 102 is ignited. The cycling by the timer means 188 prevents damage to the ballast circuit 100 in the event the lamp 102 fails to ignite for whatever reason or is not connected into the circuit.

Having thus described the invention of the present application in detail and by reference to preferred em-bodiments thereof, it will be apparent that modifications and variations are possible without departing from the scope of the invention defined in the appended claims

What is claimed is:

1. A ballast circuit for operating a discharge lamp comprising:

a source of high voltage direct current power;

low voltage direct current power supply means for converting said high voltage direct current power to low voltage direct current power for operation of said ballast circuit;

lamp starter means connected to the discharge lamp for initiating operation of the lamp from power provided by said source of high voltage direct current power;

lamp driver means for operating the discharge lamp from power provided by said source of high voltage direct current power;

capacitor means for connecting said lamp driver means to the discharge lamp;

pulse width modulation means operated from said low voltage direct current power supply means for generating control pulses for said lamp driver means in response to current flow in said lamp driver means;

switch means for selectively shorting out said capacitor means; and timer means operated from said low voltage direct current power supply means for controlling said switch means in response to current flow in said lamp driver means.

2. A ballast circuit for operating a discharge lamp as claimed in claim 1 wherein said pulse width modulation means is operated at a frequency which is a multiple of approximately 7.3 kilohertz.

3. A ballast circuit for operating a discharge lamp as claimed in claim 2 wherein said pulse width modulation means is operated at a frequency of approximately 29.2 kilohertz.

4. A ballast circuit for operating a discharge lamp as claimed in claim 1 further comprising timer control means for enabling said timer means prior to operation of the discharge lamp.

5. A ballast circuit for operating a discharge lamp as claimed in claim 4 wherein said timer means cyclically operates said switch means while enabled by said timer control means.

6. A ballast circuit for operating a discharge lamp as claimed in claim 5 wherein said timer means operates on a cycle of approximately two seconds on and two seconds off.

7. A ballast circuit for operating a discharge lamp as claimed in claim 4 wherein said timer control means comprises a comparator circuit which compares a control signal of said pulse width modulation means to a defined reference level signal.

8. A ballast circuit for operating a discharge lamp as claimed in claim 1 wherein said source of high voltage direct current power comprises high voltage direct current power supply means for receiving alternating current power and converting it to high voltage direct current power.

9. A ballast circuit for operating a discharge lamp as claimed in claim 1 wherein said low voltage direct current power supply means comprises:

primary power supply means coupled to said lamp driver means for generating low voltage direct current power for steady state operation of said ballast circuit; and bootstrap power supply means coupled between said source of high voltage direct current power and said primary power supply means for supplying low voltage direct current power for initial operation of said ballast circuit.

10. A ballast circuit for operating a discharge lamp as claimed in claim 9 wherein said bootstrap power supply means includes current limiter means for limiting current flow therethrough for extended operating times.

11. A ballast circuit for operating a discharge lamp as claimed in claim 10 wherein said current limiter means comprises a series connected resistor and thermistor.

12. A ballast circuit for operating a discharge lamp as claimed in claim 10 wherein said bootstrap power supply means includes shut-off means for turning off said bootstrap power supply means upon proper operation of said primary power supply means.

13. A ballast circuit for operating a discharge lamp as claimed in claim 12 wherein said bootstrap power supply means comprises dc-to-dc converter means for converting high voltage direct current power to low voltage direct current power and said shut-off means is connected to said primary power supply means for disabling said dc-to-dc converter means upon generation of low voltage power by said primary power supply means.

14. A ballast circuit for operating a discharge lamp as claimed in claim 13 wherein said shut-off means comprises an optical isolator.

15. A ballast circuit for operating a discharge lamp as claimed in claim 1 wherein said pulse width modulation means comprises:

current limiter means for terminating control pulses passed to said lamp driver means in response to current flow in said lamp driver means exceeding a defined limit; and selector means for selecting said defined limit for current flow in said lamp driver means.

16. A ballast circuit for operating a discharge lamp as claimed in claim 15 wherein said pulse width modulation means is further responsive to said source of high voltage direct current power and further comprises:

integrator means for integrating signals representative of current flow in said lamp driver means to generate an integrated drive current signal; and comparator means for comparing said integrated drive current signal to a defined portion of a voltage level of said source of high voltage direct current power and generating a control signal to define widths of said control pulses.

17. A ballast circuit for operating a discharge lamp as claimed in claim 16 further comprising voltage divider means connected to said source of high voltage direct current power for selecting said defined portion of its voltage level.

18. A ballast circuit for operating a discharge lamp as claimed in claim 17 further comprising voltage regulator means connected across said voltage divider means for presetting a fixed voltage across said voltage divider means while the voltage level of said high voltage direct current source is equal to or greater than a given voltage level whereby the voltage across said voltage divider means is maintained at said fixed voltage regardless of variations of said high voltage direct current source at or above said given voltage level but drops below said fixed voltage if the voltage level of said high voltage direct current source falls below said given voltage level to thereby reduce the current provided to said lamp while preventing said lamp from extinguishing.

19. A ballast circuit for operating a discharge lamp as claimed in claim 18 wherein said voltage regulator means comprises a zener diode.

20. A ballast circuit for operating a discharge lamp as claimed in claim 19 wherein said pulse width modulation means is operated at a frequency which is a multiple of approximately 7.3 kilohertz.

21. A ballast circuit for operating a discharge lamp as claimed in claim 20 wherein said pulse width modulation means is operated at a frequency of approximately 29.2 kilohertz.

* * * * *